United States Patent [19]

Arneth et al.

[11] Patent Number: 4,596,510

[45] Date of Patent: Jun. 24, 1986

[54] CENTRIFUGAL PUMP FOR HANDLING OF LIQUID CHLORINE

[75] Inventors: Helmüt Arneth, Leinburg; Adolf Kratzer, Nürnberg, both of Fed. Rep. of Germany

[73] Assignee: Klein, Schanzlin & Becker Aktiengesellschaft, Frankenthal(Pfalz), Fed. Rep. of Germany

[21] Appl. No.: 364,631

[22] Filed: Apr. 2, 1982

[30] Foreign Application Priority Data

Apr. 4, 1981 [DE] Fed. Rep. of Germany ..... 3113662

[51] Int. Cl.[4] ..... F04D 29/08

[52] U.S. Cl. ..... 415/175; 415/170 B; 415/109

[58] Field of Search ..... 415/116, 170 B, 175, 415/108, 109

[56] References Cited

U.S. PATENT DOCUMENTS

| | | | |
|---|---|---|---|
| 2,949,321 | 8/1960 | Tracy | 415/175 X |
| 3,024,734 | 3/1962 | Dickson et al. | 415/109 |
| 3,071,384 | 1/1963 | Friberg | 415/175 X |
| 3,610,416 | 10/1971 | Otto | 415/109 X |
| 4,239,422 | 12/1980 | Clancey | 415/116 X |

FOREIGN PATENT DOCUMENTS

| | | | |
|---|---|---|---|
| 5336701 | 4/1978 | Japan | 415/170 B |

*Primary Examiner*—Harvey C. Hornsby
*Assistant Examiner*—Frankie L. Stinson
*Attorney, Agent, or Firm*—Peter K. Kontler

[57] ABSTRACT

A machine for pumping liquid chlorine employs an upright shaft sump pump which is confined in a hermetically sealed housing and has a tubular supporting element surrounding the pump shaft. The latter is mounted in overhung position and is adjacent to a pressure pipe which conveys the pressurized liquid. The shaft seal is kept out of contact with the liquid by the housing as well as by a body of inert gas which is supplied to the interior of the housing and to the space between the shaft and the tubular element at a pressure depending on the pressure of inflowing liquid chlorine and being sufficiently high to prevent the inflow of liquid chlorine into the housing and/or tubular element when the pump is idle. The main impeller on the pump shaft is made integral with an auxiliary impeller which constitutes a hydrodynamic shaft seal and prevents the flow of conveyed liquid chlorine into the tubular element from below.

9 Claims, 1 Drawing Figure

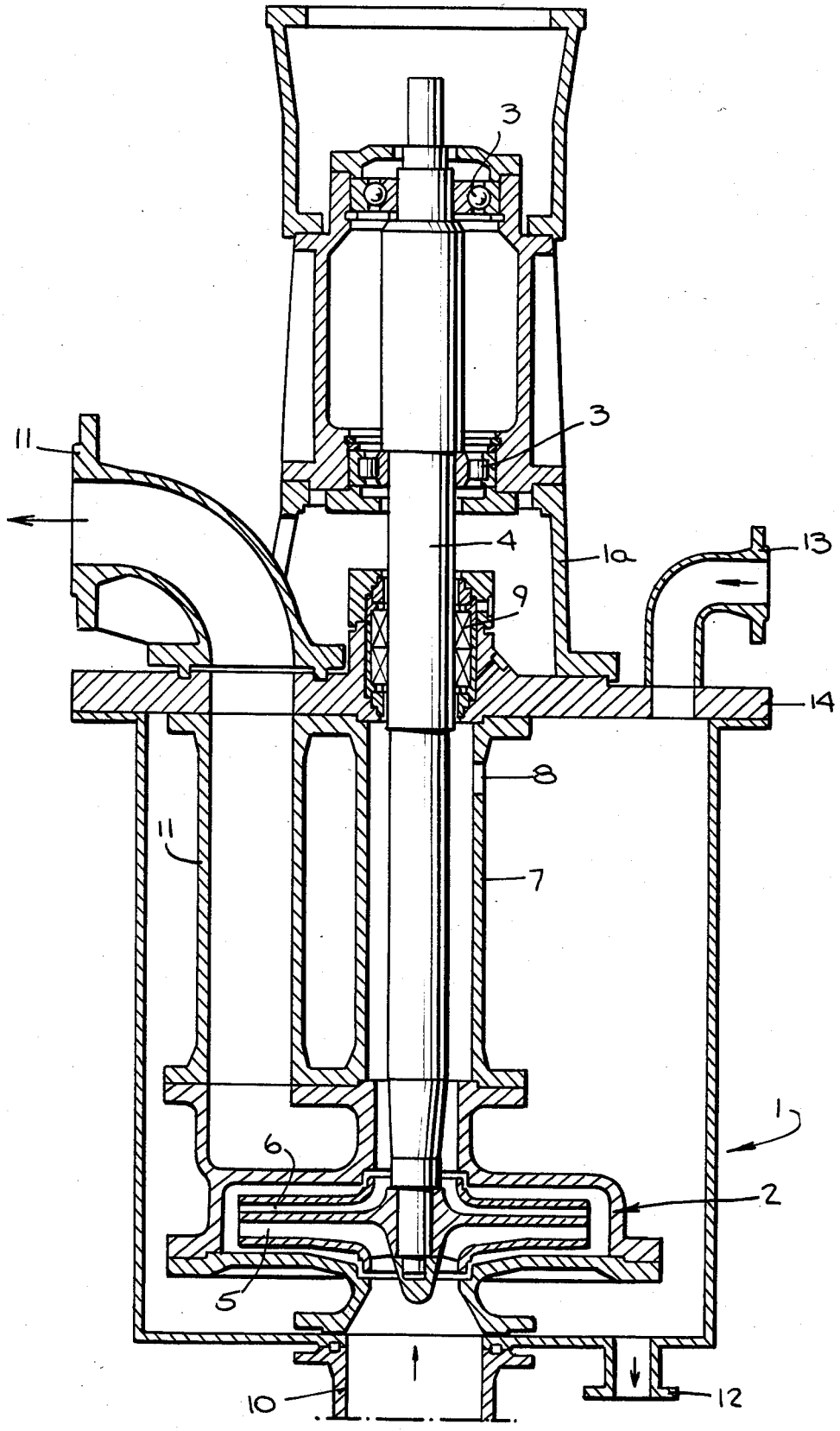
3
3
11
4
1a
13
9
14
8
11
7
1
6
2
5
10
12

CENTRIFUGAL PUMP FOR HANDLING OF LIQUID CHLORINE

BACKGROUND OF THE INVENTION

The present invention relates to centrifugal pumps in general, and more particularly to improvements in so-called chemical centrifugal pumps or tank farm pumps for handling of liquid chemicals, especially liquid chlorine.

In accordance with heretofore known proposals, liquid chlorine is pumped by resorting to canned motor pumps without shaft seals, magnetic coupling pumps or conventional wet-mounted shaft sump pumps with the shaft sealed leaktight at its passage out of the tank. In each embodiment, the rotor is mounted in one, two or more submerged bearings which are lubricated by the circulated liquid. In order to avoid corrosion, chlorine is often circulated at elevated temperatures such as to exclude icing, misting or fogging of component parts of the plant. However, this produces certain undesirable side effects, such as a greatly reduced lubricating action of chlorine as well as a greatly increased chemical aggressiveness of chlorine upon various bearing materials. This, in turn, greatly reduces the useful life of the bearings which are used in such types of pumps. An additional drawback of handling of liquid chlorine at elevated temperatures is that, in a canned motor pump, heat which is generated by the motor must be led away by a partial liquid stream which is intended for the lubrication of bearings; this brings about additional undesirable effects upon the lubricating qualities of liquid chlorine and further reduces the useful life of the bearings.

In machines of the just outlined character, pronounced wear upon the bearings entails metallic contact between rotary and stationary parts, especially between rotary parts and portions of the housing. The resulting friction entails the development of elevated temperatures which can lead to combustion of chlorine. It will be readily appreciated that pronounced friction is especially damaging in narrow clearances between races of bearings and adjacent ring-shaped parts as well as, in the case of canned motor or magnetic coupling pumps, between the rotor and the stator. If metallic contact is not detected without delay and the pump is not arrested in immediate response to such detection, one risks the development of cracks in the walls which allow the escape of chlorine into the surrounding area. Monitoring of wear upon the bearings cannot eliminate the just discussed problems because leaks can develop in the stator can (whose thickness is in the range of a few tenths of one millimeter), for example, as a result of penetration of foreign matter which remains entrapped in the narrow clearance.

Attempts to prevent escape and/or burning of chlorine include other expensive proposals, for example, the utilization of detectors which furnish signals in response to penetration of chlorine into the interior of the stator. Furthermore, it is necessary to manufacture all such parts which are subjected to elevated pressures from special materials whose combustion temperature in chlorine is relatively high. Suitable materials of such character include nickel alloys or other substances having a relatively high nickel content which contributes excessively to the initial cost of the machine.

OBJECTS AND SUMMARY OF THE INVENTION

An object of the invention is to provide a relatively simple and inexpensive but highly reliable and long-lasting pump for the handling of liquid chemicals, particularly for handling of liquid chlorine.

Another object of the invention is to provide a pump for the handling of liquid chlorine which operates properly at elevated temperatures and under circumstances which are subject to pronounced changes at frequent intervals.

A further object of the invention is to provide a chemical pump, such as a vertical chemical pump, which is especially suited for the handling of liquid chlorine and can operate properly for extended periods of time in the absence of any detectors or other monitoring equipment.

An additional object of the invention is to provide the pump with novel and improved means for preventing contact between the conveyed liquid and the seals and/or other sensitive components of the machine.

Another object of the invention is to provide a chemical pump or a tank farm pump, especially a pump for the handling of liquid chlorine, wherein the bearings for the pump shaft can stand longer periods of uninterrupted and unsupervised use than in heretofore known pumps of such character.

The invention is embodied in a machine for pumping liquids, particularly liquid chlorine, which comprises a shaft sump pump having a preferably upright rotary shaft, a shaft seal, a tubular supporting element spacedly surrounding the shaft, and a pressure pipe for evacuation of pressurized liquid. The machine further comprises a housing which hermetically seals the shaft seal from the surrounding atmosphere and from the pumped liquid. Means are provided for mounting the shaft in overhung position. The pump further comprises a first or main impeller and preferably a second or auxiliary impeller which is installed downstream of (behind) the main impeller, as considered in the direction of liquid flow through the pump. The impellers are mounted on and are driven by the pump shaft, and the auxiliary impeller can be made integral with the main impeller. This arrangement enables the auxiliary impeller to act not unlike a hydrodynamic shaft seal which eliminates the dynamic pump head and suction pressure and thus prevents the flow of pumped liquid into the tubular element.

The tubular element is preferably formed with one or more openings in the upper portion thereof, preferably in the upper third of the tubular element, to permit the flow of fluid between the interior of the housing and the space surrounding the shaft within the confines of the tubular element.

The machine preferably further comprises means for admitting a compressed inert gas, such as nitrogen, into the interior of the housing and into the interior of the tubular element at a pressure which suffices to ensure that the liquid cannot penetrate into the housing when the pump is idle. As mentioned above, the tubular element has one or more openings which allow for equalization of pressures externally of and within the tubular element, i.e., for the flow of inert gas from the interior of the housing into the space surrounding the pump shaft within the confines of the tubular element.

The novel features which are considered as characteristic of the invention are set forth in particular in the appended claims. The improved machine itself, however, both as to its construction and its mode of operation, together with additional features and advantages thereof, will be best understood upon perusal of the following detailed description of certain specific embodiments with reference to the accompanying drawing.

BRIEF DESCRIPTION OF THE DRAWING

The single FIGURE of the drawing is an axial sectional view of an upright chemical pump which embodies the present invention and wherein the main impeller is integral with an auxiliary impeller.

DESCRIPTION OF THE PREFERRED EMBODIMENTS

The drawing shows a machine including a centrifugal chemical pump or tank farm pump 2 which is particularly suited for the handling of liquid chlorine or similar liquid chemicals. The pump 2 is a shaft sump pump and is mounted in a housing 1 whose interior is hermetically sealed from the surrounding atmosphere. The rotor of the pump 2 includes an upright shaft 4 mounted in overhung position in a bell 1*a* and carrying, at its lower end, a main impeller 5 with an integral auxiliary impeller 6 at the rear (downstream) side thereof. The upper end portion of the pump shaft 4 is rotatable in thrust bearings 3 mounted in the bell 1*a*. That portion of the shaft 4 which is disposed above the impellers 5, 6 but below the lower thrust bearing 3 is surrounded by a tubular supporting element 7 having in its upper portion (namely, in the portion which includes the upper third thereof) at least one pressure equalizing opening 8. The upper end portion of the tubular element 7 is disposed below a double-acting mechanical shaft seal 9 which is acted upon by a suitable blocking fluid in a manner not forming part of the present invention. The seal 9 is not contacted by the conveyed liquid which enters via inlet 10 and issues via pressure pipe 11. The impeller 5 draws the liquid via inlet 10 when the shaft 4 is driven by a motor, not shown, which is installed at a level above the bell 1*a*. Furthermore, the housing 1 is formed with a first nipple 13 which admits an inert gas (such as nitrogen) and a second nipple 12 for discharge of the gas. The inert gas is admitted at an elevated pressure to prevent penetration of conveyed liquid into the interior of the housing 1. The inert gas also fills the interior of the tubular element 7 (note the opening 8), and its pressure (which depends on the pressure of liquid flowing into the inlet 10) is sufficiently high to prevent penetration of conveyed liquid into the element 7 and thence into the housing 1 even when the pump 2 is arrested. When the pump 2 is in operation, the auxiliary impeller 6 acts not unlike a hydrodynamic shaft seal so that the dynamic pump head and the suction pressure can be reduced to zero and the element 7 cannot be filled with the conveyed liquid. The housing 1 and the bell 1*a* are mounted at the opposite sides of a plate-like carrier 14.

It will be noted that the seal 9 remains dry under all circumstances when the pump 2 operates properly because it is shielded from the liquid by the hermetically sealed housing 1 as well as by the pressurized inert gas which fills the interior of the housing and the space surrounding the shaft 4 within the confines of the element 7.

An important advantage of the improved machine is that the pump 2 is not sensitive to contaminants which are contained in the conveyed liquid irrespective of whether the contaminants are solids or liquids. The bearings 3 are lubricated with grease which does not come in contact with the conveyed liquid. Therefore, such bearings can be readily inspected, serviced and/or repaired. The placing of the pump 2 into the hermetically sealed housing 1 by itself offers a high degree of protection against undesirable escape of the liquid. In addition, such mounting of the pump 2 renders it possible to provide for additional safety and monitoring features such as the provision of the aforementioned auxiliary impeller 6 which performs the function of a hydrodynamic shaft seal when the pump 2 is in use, the provision of opening or openings 8 in the upper third of the tubular element 7, and the filling of the housing 1 and element 7 with a compressed inert gas whose pressure is selected with a view to prevent the penetration of liquid into the housing 1 when the pump 2 is idle.

Another important advantage of the improved pump 2 is that the bearings 3 for the shaft 4 are shielded from the conveyed liquid so that they can be lubricated in a suitable way without the need to rely on the greatly reduced lubricating action of heated liquid chlorine. As mentioned above, lubrication with liquid chlorine which is maintained at an elevated temperature entails the development of metallic contact between stationary and rotary parts of bearings in conventional chemical pumps after relatively short periods of use. This, in turn, leads to the escape and burning of chlorine except by resorting to complex, bulky and expensive safety and monitoring devices all of which can be dispensed with in the improved machine.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

We claim:

1. A machine for pumping liquids, particularly liquid chlorine, comprising a shaft sump pump mounted in a housing, the interior of which is hermetically sealed from the atmosphere, said pump having a rotary shaft mounted in an overhung position, the upper portion of said shaft adapted to be rotated by drive means positioned outside of said housing, a shaft seal provided about said rotary shaft outside of the hermetically sealed housing and out of contact with the pumped liquids, a tubular supporting element surrounding the portion of the shaft within said housing, inlet means for admitting liquids into said pump within said housing, a pressure pipe for evacuation of liquid and means for admitting a compressed inert gas into the interior of said housing and said supporting element at a pressure such that the liquid cannot penetrate into said housing and contact said shaft seal when the pump is idle.

2. The machine of claim 1, wherein said pump further includes a first impeller and an auxiliary impeller both mounted on and driven by said shaft.

3. The machine of claim 2, wherein said auxiliary impeller is installed downstream of the first impeller, as considered in the direction of liquid flow from said inlet means through said pump.

4. The machine of claim 3, wherein said auxiliary impeller constitutes a hydrodynamic shaft seal which eliminates the dynamic pump head and suction pressure and thus prevents the flow of pumped liquid into said supporting element.

5. The machine of claim 1, wherein said shaft is an upright shaft.

6. The machine of claim 5, wherein said supporting element spacedly surrounds said shaft and has an upper portion provided with at least one opening allowing for communication between the interior of said housing and the space surrounding said shaft within the confines of said supporting element.

7. The machine of claim 6, wherein said upper portion includes the upper third of said supporting element.

8. The machine of claim 1, wherein the inert gas is nitrogen.

9. The machine of claim 1, wherein said supporting element has an opening for admission of inert gas from the interior of said housing into the interior of said supporting element.

* * * * *